US006745872B2

(12) United States Patent
Sato

(10) Patent No.: US 6,745,872 B2
(45) Date of Patent: Jun. 8, 2004

(54) REFUGE DEVICE FROM HIGH PLACE

(75) Inventor: Toshiaki Sato, Teradomari-machi (JP)

(73) Assignee: Kabushiki Kaisha Sato Seisakusho, Niigata-Ken (JP)

( * ) Notice: Subject to any disclaimer, the term of this patent is extended or adjusted under 35 U.S.C. 154(b) by 0 days.

(21) Appl. No.: 10/331,652

(22) Filed: Dec. 31, 2002

(65) Prior Publication Data

US 2003/0136610 A1 Jul. 24, 2003

(30) Foreign Application Priority Data

Jan. 24, 2002 (JP) ..... 2002-015733

(51) Int. Cl.[7] ..... A62B 1/00
(52) U.S. Cl. ..... 182/238; 182/233
(58) Field of Search ..... 182/231–240, 182/73, 71, 72; 254/377

(56) References Cited

U.S. PATENT DOCUMENTS 3,946,989 A * 3/1976 Tsuda ..... 182/241
4,037,545 A * 7/1977 Dreyer ..... 111/197
4,437,546 A * 3/1984 Marinoff et al. ..... 182/233

FOREIGN PATENT DOCUMENTS

JP 3-62114 B2 9/1991

* cited by examiner

*Primary Examiner*—Alvin Chin-Shue
(74) *Attorney, Agent, or Firm*—Sughrue Mion, PLLC

(57) ABSTRACT

A modified hole is simply fitted and retained to a rotary shaft so that a pulley may be coupled so as to be rotated together with the rotary shaft, in particular, pulley forming plates are coupled in a rotation preventing manner but slidably to the rotary shaft, an interval of a pulley groove may be formed to be variable with ease, even if the rope is loosened in an initial stage upon descending and so on and a rope has the minimum winding diameter at once due to the change in the pulley groove interval so that the rope is brought into pressing contact with the rotary shaft outer circumferential surface.

2 Claims, 7 Drawing Sheets

REFUGE DEVICE FROM HIGH PLACE

BACKGROUND OF THE INVENTION

The present invention relates to a refuge device from a high place (a portable refuge tool), by which a person who has any body weight such as a child and an adult may descend from the high place to the ground substantially at a constant velocity at all the time in the case where he or she takes refuge from the high place and so on.

There has been conventionally provided a portable refuge tool that may descend to the ground at a constant velocity from a high place of a building in case of emergency such as fire.

However, in the conventional refuge tool, there is an allowance range for the load, and the refuge tool is used in accordance with the weight of the person who uses the tool.

For instance, a refuge tool used by a person having a body weight of 40 kg and a refuge tool used by a person having a body weight of 80 kg are different from each other. If the refuge tool to be used for the person having the body weight of 40 kg is used for the person having the body weight of 80 kg, then the refuge tool does not work as the refuge tool, which is very dangerous.

Accordingly, this type refuge tools should be prepared for various persons who are to use them. For instance, in hotels or Japanese style ryokan (hotels), a variety of refuge tools should be prepared in conformity with various allowance body weights while estimating the body weights of the persons who are to use the tools. This is very inconvenient.

Therefore, as a result of the long term studies, the present inventor had invented a portable refuge tool that could descend substantially at a constant velocity even if the refuge tool was used to a person having any body weight (JPB Hei 3-62114).

The present invention is a further improvement to the above-described invention as a base. More specifically, in an arrangement in which a plurality of static plates (brake plates) rotating in oil are provided on a rotary shaft provided with a pulley whose winding diameter is varied in response to the body weight (load), the outer shape of this rotary shaft is formed into a rotation preventing shape in order to enhance the mass productivity with an easy manufacturing and assembling property without increasing the cost. At the same time, modified holes that may fit and retain in conformity with this outer shape is provided in the static plates or a pulley forming plate. As a result, simply by fitting and retaining the modified holes to the rotary shaft, it is possible to couple the pulley (static plates) with the rotary shaft to be rotated together. In addition, even if a rope is loosened in the initial stage upon the descending and the rope has the minimum winding diameter abruptly by the change of the pulley groove so that the rope is brought into the outer circumferential surface of the rotary shaft, the outer shape of the rotary shaft is not formed simply into a rectangular shape or a hexagonal shape in cross section in order not to generate any cutting force locally in the rope neither simply into a key shape to provide a novel refuge tool from a high place in which a number of convex and concave stripes are formed in concave and convex outer circumferential surface continuously in the circumferential direction.

SUMMARY OF THE INVENTION

The summary of the invention will now be described.

According to the present invention, there is provided a refuge device from a high place in which a rotary shaft is provided rotatably within a casing provided with a rope winding portion around which a rope is wound feedably, a pulley for winding the rope to be fed is provided on the rotary shaft, static plates rotating within a closed chamber filled with oil and generating a brake force are provided on the rotary shaft, an interval of a pulley groove of the pulley is varied in response to a load to adjust the winding diameter, and a rope feeding brake mechanism for controlling so that the rope feeding velocity is kept substantially at the constant velocity irrespective of the magnitude of the load is provided, characterized in that an outer circumferential surface of the rotary shaft on which the pulley is provided and with which the rope is brought into contact while the winding diameter is at minimum upon the application of a large load is formed into a concave and convex outer circumferential surface formed by a number of circumferentially juxtaposed concave and convex stripes having a length in an axial direction and a modified hole identified with the concave and convex outer circumferential surface is fitted and retained to the rotary shaft whereby pulley forming plates of the pulley are coupled in a rotation preventing manner but slidably to the rotary shaft.

Also, according to the present invention, there is provided the refuge device from a high place according to the first aspect of the invention, wherein apex portions of convex portions forming the concave and convex outer circumferential surface is rounded and chamfered and formed into the concave and convex outer circumferential surface concave and convex continuously in a wavy form in the circumferential direction, whereby when the rope is brought into contact with the concave and convex outer circumferential surface of the rotary shaft upon the application of a large load, a local cutting force is hardly generated in the rope.

The best mode of the present invention (how to embody the invention) will briefly be described with resultant effects.

For instance, after the rope wound around the rope winding portion provided in the casing is wound around the pulley of the rotary shaft provided within the casing, the rope is fed out to the outside of the casing, the fed-out end is fixed to, for example, the building side, the casing is mounted through a mounting portion on the person who takes refuge from the high place, when the person descend from the high place, the rope fed while rotating drum is fed out to the outside of the casing while rotating the rotary shaft through the pulley for descending, at this time, the plurality of static plates are provided on the rotary shaft, the static plates generate the rotational resistance (brake force) for rotation within the closed chamber filled with the oil, and also, the pulley groove is varied in response to the load, the winding diameter is varied to the rotary shaft of the rope so that the rope is fed substantially the same velocity irrespective of the magnitude to the load (body weight) and the person may descend substantially at the same velocity.

The theory why the descending velocity is kept substantially constant is described in JPB Hei 3-62114 and accordingly the detailed explanation therefor will be omitted.

Furthermore, according to the present invention, the outer shape of the rotary shaft is formed into the rotation preventing shape. At the same time, the modified hole that is identified with the outer shape and fitted and retained is formed in the pulley forming plates (static plates) of the pulley. Only and simply by fitting and retaining the modified hole to the rotary shaft, the pulley (static plates) may be coupled to be rotated together with the rotary shaft. In particular, the pulley forming plates are slidably coupled to the rotary shaft in a rotation preventing manner so that the pulley groove may be varied in response to the load. Accordingly, it is easy to manufacture and to facilitate the device without increasing the cost, which enhance the mass productivity.

Furthermore, since the outer shape of the rotary shaft is not simply into the rectangular shape or the hexagonal shape in cross section or the key shape is not formed into a single shape but the outer shape is formed into the concave and convex outer circumferential surface by a number of concave and convex stripes having a length in the axial direction that are continuous in the circumferential direction, even if the rope is loosened in the initial stage upon descending and the rope has the minimum winding diameter at once due to the change of the pulley groove so that the rope is brought into contact with the rotary shaft outer surface (concave and convex outer circumferential surface), the rope is hardly brought into pressing contact only with one corner edge and is likely to slip because of a number of concave and convex portions. Accordingly, since the local cutting force is hardly generated in the rope, the safety aspect is enhanced to thereby provide a novel refuge device from a high place which is extremely superior in practical use.

DESCRIPTION OF THE PREFERRED EMBODIMENTS

Figure 1:
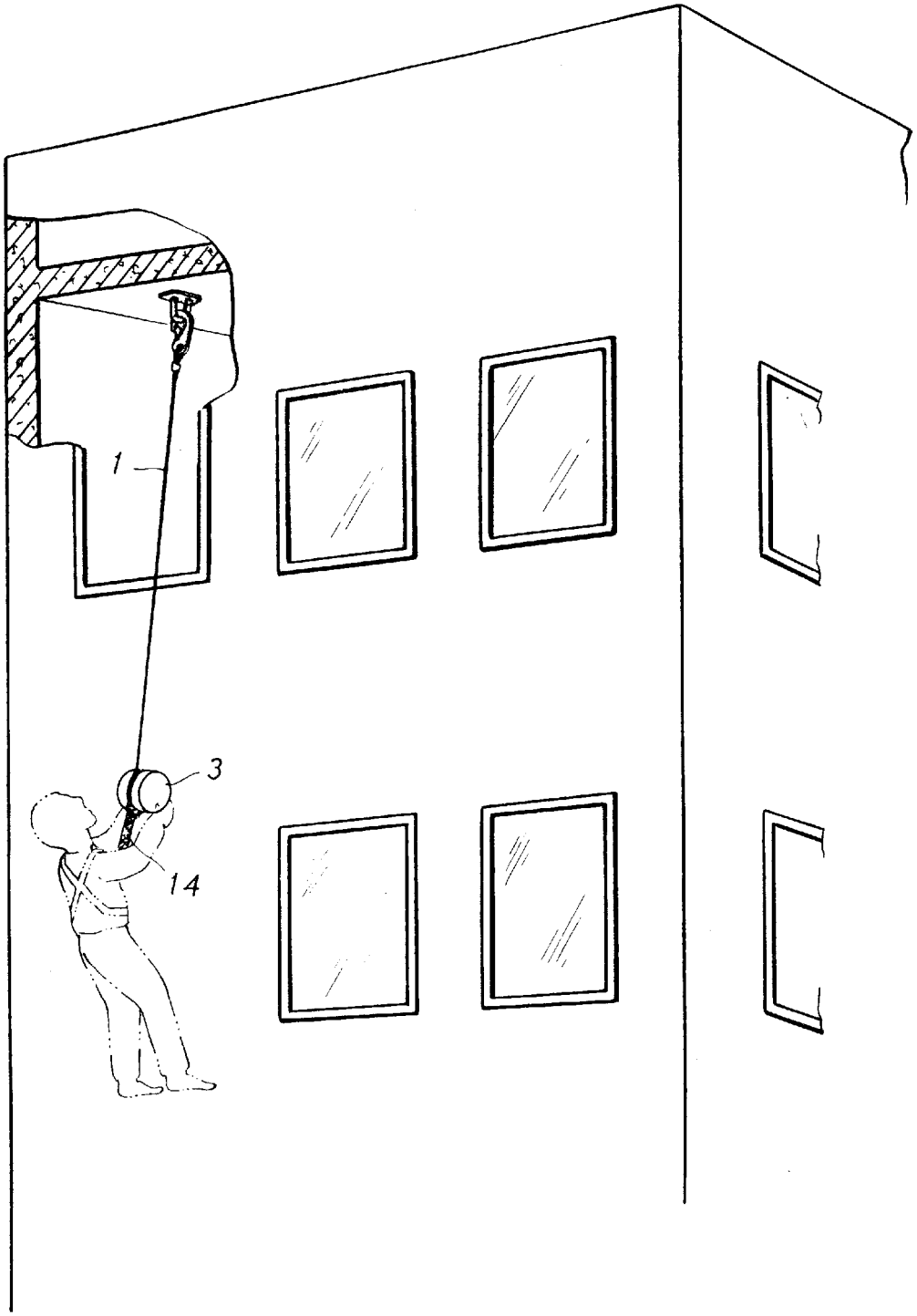
FIG. 1 is an illustration showing a use condition of the present embodiment.
Figure 2:
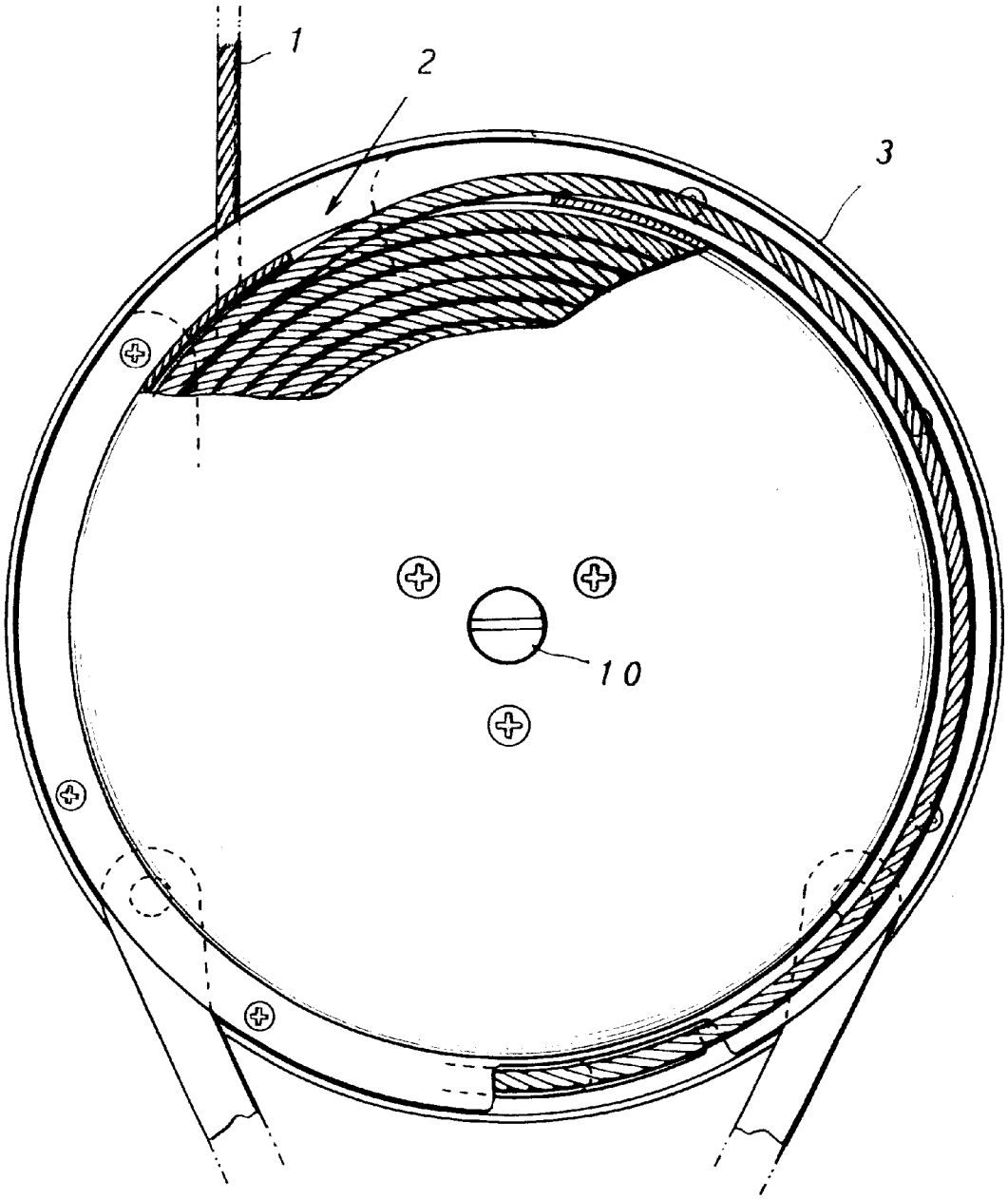
FIG. 2 is a cross-sectional view showing the case where the rope is fed out from the rope winding portion according to the embodiment.
Figure 3:
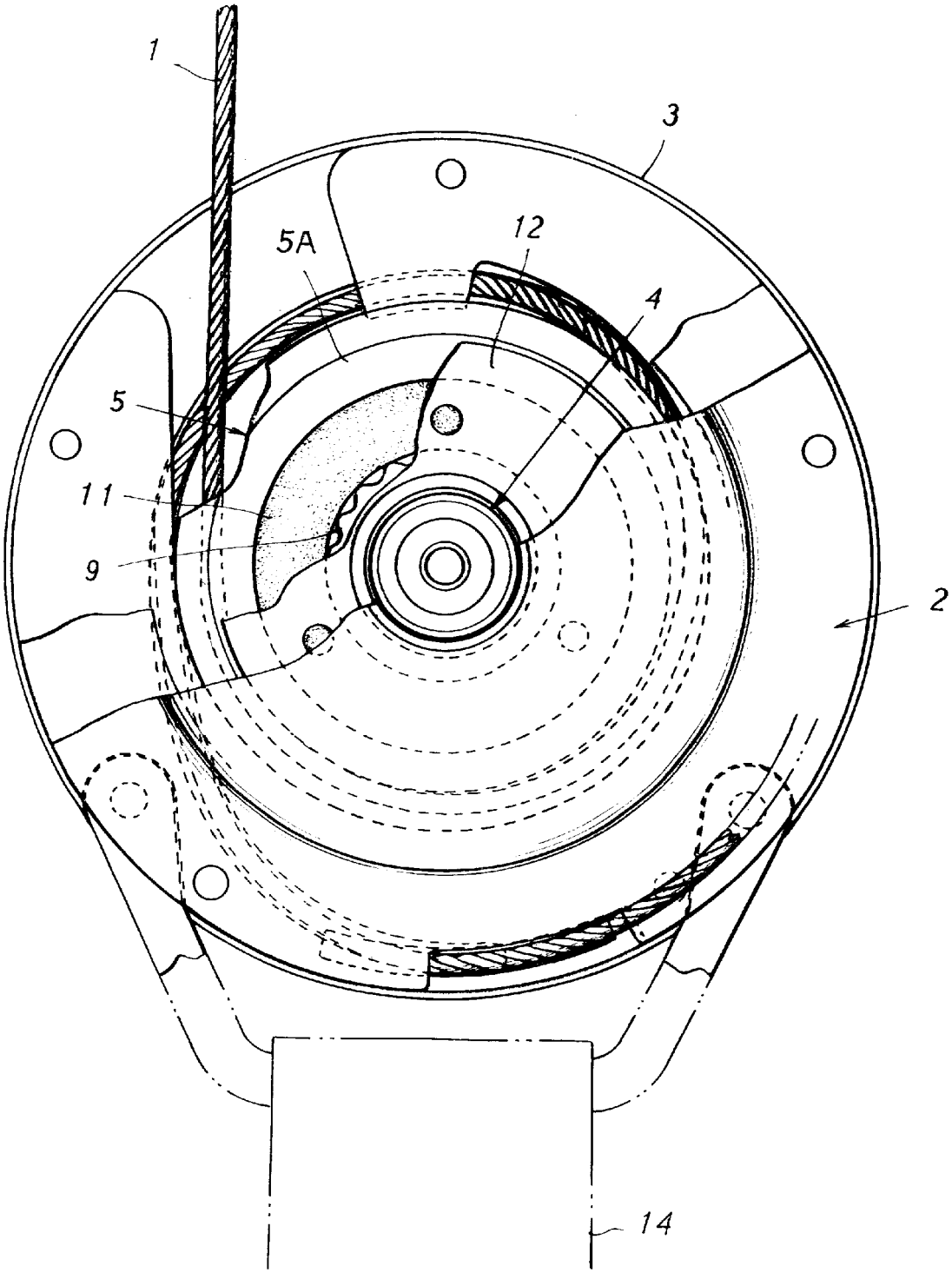
FIG. 3 is a cross-sectional view showing the case where the rope is fed out through the pulley from the rope winding portion.
Figure 4:
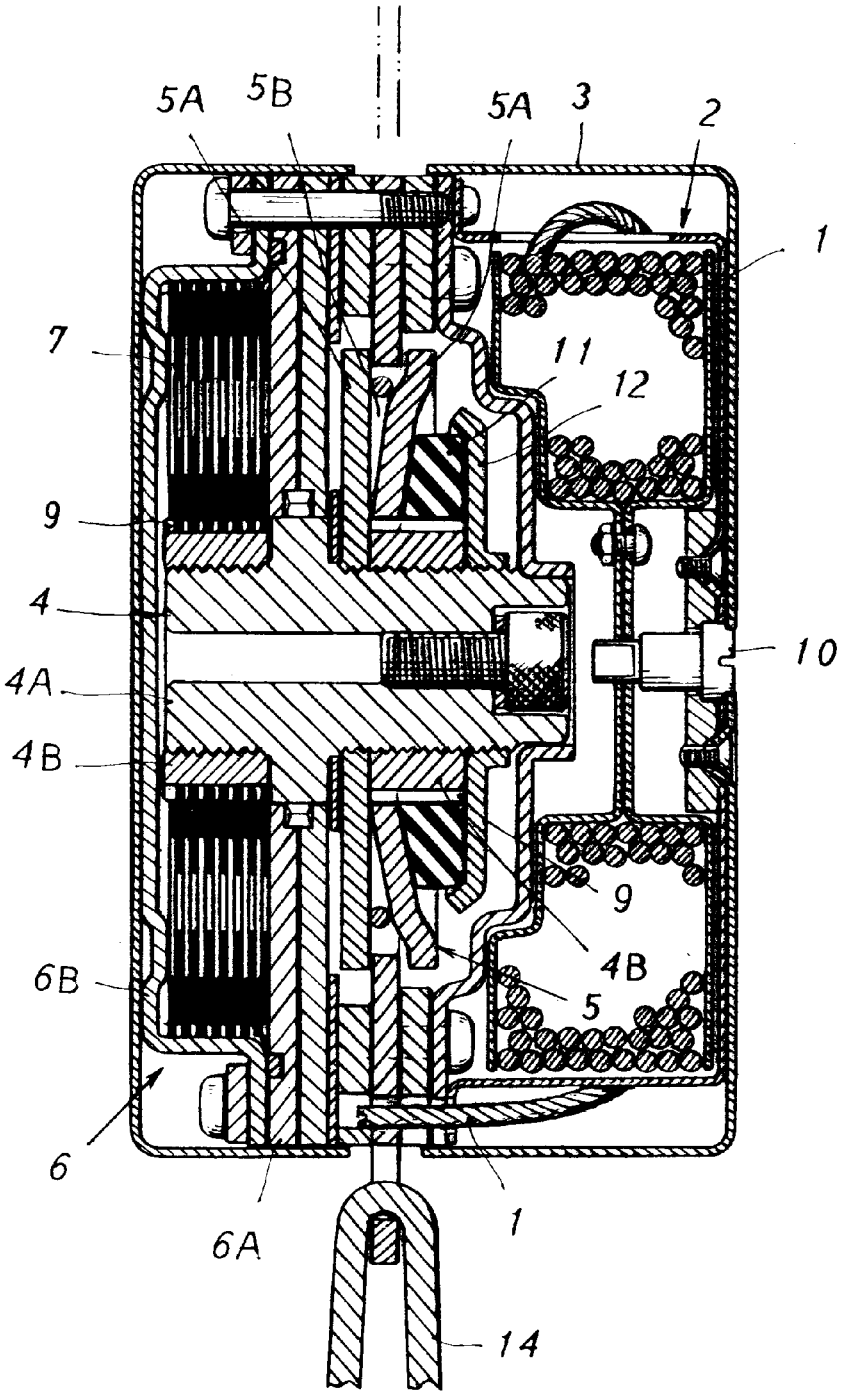
FIG. 4 is a cross-sectional view upon light load application in this embodiment.
Figure 5:
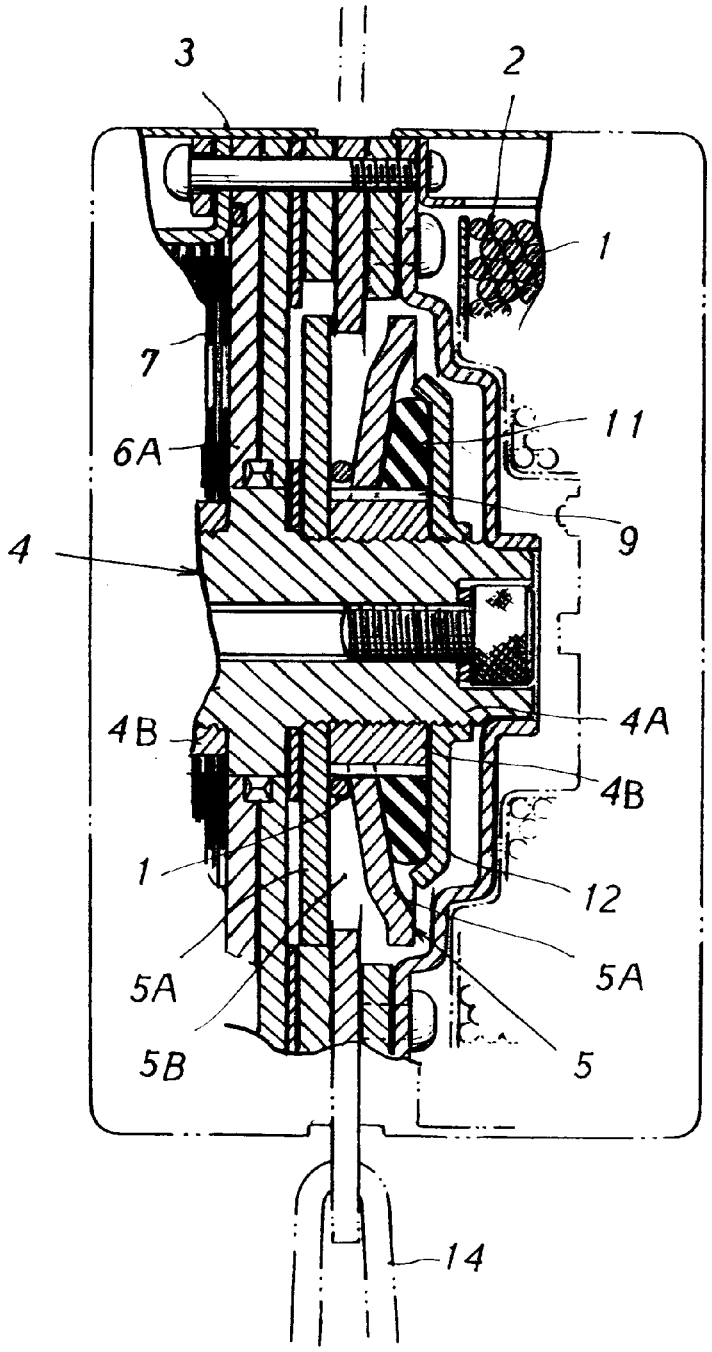
FIG. 5 is a cross-sectional view upon heavy load application in this embodiment.
Figure 6:
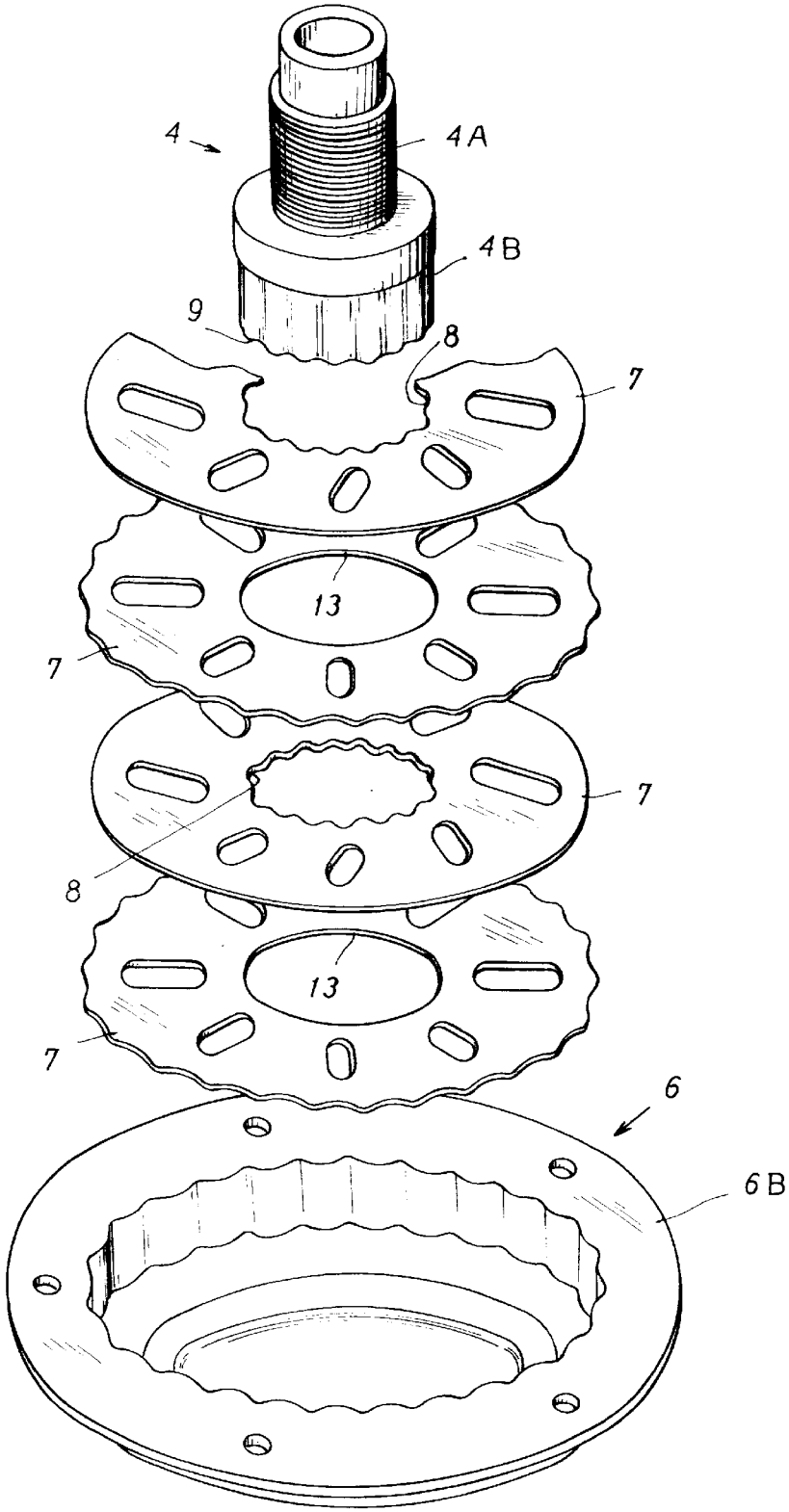
FIG. 6 is an exploded perspective view of a closed chamber portion according to this embodiment.
Figure 7:
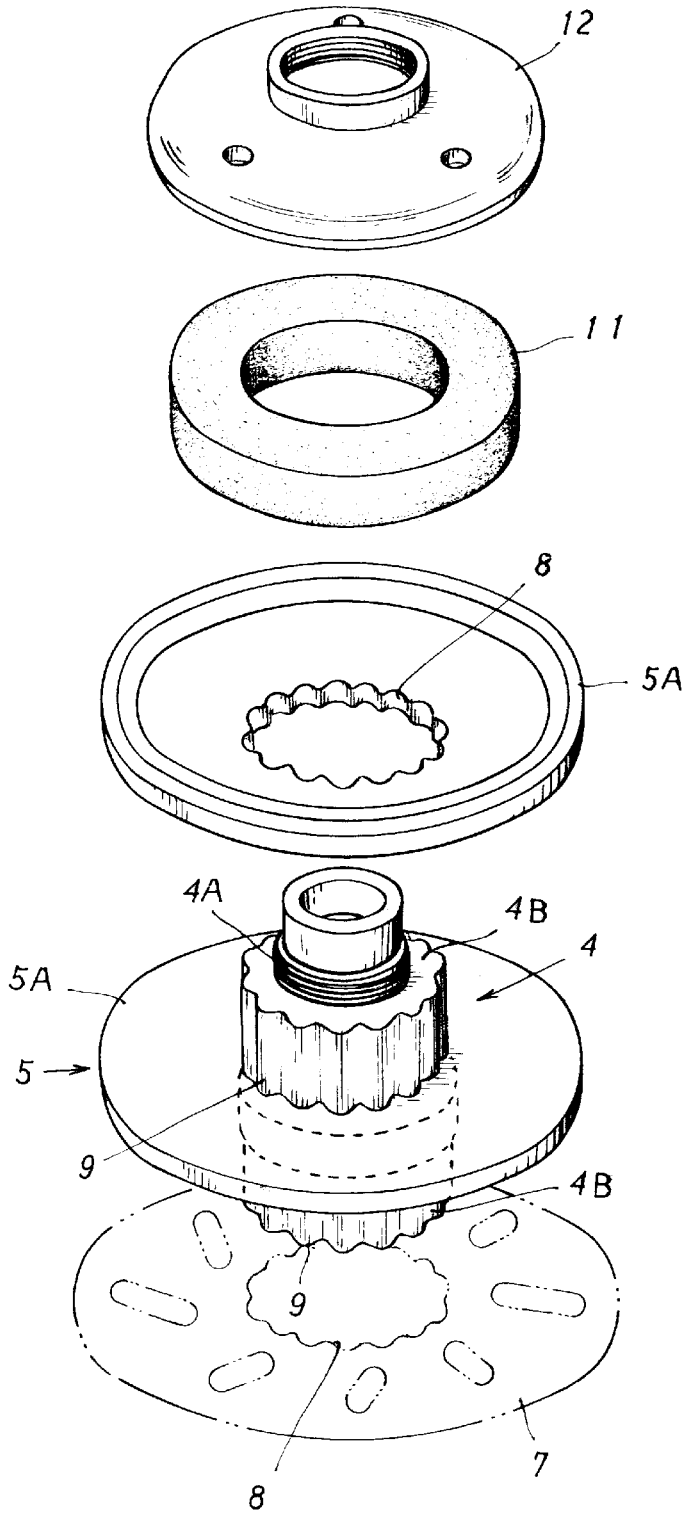
FIG. 7 is an exploded perspective view of a pulley portion according to this embodiment.

A specific embodiment of the present invention will now be described with reference to the accompanying drawings.

In this embodiment, a rope 1 (for example, wire rope) is wound and received feedably in a drum (rope winding portion 2) provided in a body 3 of a casing. A rotary shaft 4 is provided rotatably within the body 3. A pulley 5 around which the rope 1 to be fed is wound by only one turn is provided to the rotary shaft 4. A rotational adjustment screw frame 10 provided on a shaft portion of the drum 2 is manually rotated by a tool or the like so that the loose may be eliminated.

Also, a number of static plates 7 rotating within a closed chamber 6 filled with oil for generating a brake force are provided at an interval to the above-described rotary shaft 4. An interval of the pulley groove 5B of the above-described pulley 5 is varied in response to the load by a return force by an elastic member 11 or a winding force of the rope 1 so that the winding diameter may be adjusted. As a result, the feeding speed of the rope may be kept substantially at the same velocity irrespective of the magnitude of the load. Such a brake mechanism is provided on the rotary shaft 4.

Also, an outer circumferential surface of the rotary shaft 4 on which the above-described pulley 5 is provided and with which the above-described rope 1 is brought into contact when the above-described winding diameter is at minimum upon the heavy load applied are formed into concave and convex outer circumferential surfaces 9 on which a number of convex and concave stripes having a length in the axial direction are provided in parallel and formed in the circumferential direction. A modified hole 8 that is identified with the concave and convex outer circumferential surface 9 is provided in one of pulley forming plates 5A of the above-described pulley 5 and the above-described static plates 7. This modified hole 8 is fitted and retained to the above-described rotary shaft 4 whereby one pulley forming plate 5A and the static plates 7 are coupled to each other in a rotational preventing manner, and in particular, the one pulley forming plate 5A is coupled slidably. The pulley forming plate 5A is slidably moved to thereby vary the pulley groove 5B.

More specifically, each apex portion of convex portions forming the above-described concave and convex outer circumferential surface 9 is rounded or chamfered to form the concave and convex outer circumferential surface 9 concave and convex continuously in the circumferential direction. Even if the rope 1 is loosened in the initial stage of the descend and the rope 1 has the minimum winding diameter at once due to the change of the pulley groove 5B so that the rope 1 is brought into contact with the rotary shaft outer surface (the convex and concave outer circumferential surface 9), there is no fear that the rope 1 would be brought into pressing contact with some corner edges. Also, because of the easy slippage due to the number of convex and concave portions, the cutting force is hardly generated locally in the rope 1.

Also, the hole edge shape is formed into the concave and convex hole edge concave and convex continuously in the circumferential direction so that the above-described modified hole 8 is identified with the concave and convex outer circumferential surface 9 and retained to be prevented from rotating.

Describing more specifically, a sleeve 4B provided on its outer circumferential surface with the above-described concave and convex outer circumferential surface 9 is threadedly fitted around a screw rod 4A that forms a main rod of the rotary shaft 4, and an outer circumferential surface at predetermined positions is formed into the above-described concave and convex outer circumferential surface 9 to form the rotary shaft 4.

Also, the above-described closed chamber 6 may be formed in any way. However, in this embodiment, in order to facilitate the assembling work and to enhance the mass productivity, one of closed chamber forming plates 6A is fitted in the central portion of the rotary shaft 4. The other dish-like closed chamber forming plate 6B is coupled with and fixed to the one closed chamber forming plate 6A to form the closed chamber 6.

Oil (silicone oil) having a high viscosity is filled in the closed chamber 6. The concave and convex outer circumferential surface 9 formed by fitting and screwing the sleeve 4B onto the screw rod 4A is provided on the rotary shaft 4 within the closed chamber 6. A simple circular fitting hole 13 is not formed in at least some of the static plates 7 but a modified hole 8 coupling and rotating with the rotary shaft 4 while identifying the concave and convex outer circumferential surface 9 is formed in the static plates 7. A number of static plates 7 are mounted on the rotary shaft 4 through the modified hole 8 or the fitting hole 13. The static plates 7 having the modified hole 8 may be rotated within the oil of the closed chamber 6 together with the rotary shaft 4.

A number of holes are formed in each static plate 7 so as to generate the sufficient rotational resistance (brake force) due to the oil.

The pulley 5 is formed on the opposite side of the rotary shaft where the closed chamber 6 is formed.

The pulley 5 is formed of the pair of pulley forming plates 5A. The mounting hole of one pulley forming plate 5A is threaded into the screw rod 4A of the rotary shaft 4 and the other pulley forming plate 5A is formed into such a shape that the interval of the pulley groove 5B becomes smaller as closer to the rotary shaft 4 (on the deeper side). The above-described modified hole 8 is formed in the middle of the pulley forming plate 5A as the mounting hole. This modified hole 8 is coupled and retained to the concave and convex outer circumferential surface 9 of the rotary shaft 4 provided by the above-described sleeve 4B in a rotation preventing manner. At the same time, the modified hole 8 is provided slidably in the axial direction of the rotary shaft 4 along with the convex and concave stripes of the concave and convex outer circumferential surface 9.

A ring-like elastic member 11 fitted around the rotary shaft 4 is disposed on the back portion of the other pulley forming plate 5A provided slidably but in a rotation preventing manner. Furthermore, a support plate 12 fitted and screwed around the rotary shaft 4 is adapted to support the elastic member 11. When the load is large, the rope 1 is adapted to slidingly move the pulley forming plate 5A somewhat in the axial direction relative to the stationary one side pulley forming plate 5A and to expand the interval of the pulley groove 5B. When the load is large, the elastic member 11 supported to the above-described support plate 12 is depressed and shrunk so that the other pulley forming plate 5A is depressed and opened and the rope 1 is caused to be close to the rotary shaft 4. When the rather large load is applied as a result of which, for example, the rope 1 is loosened upon descending, the rope 1 reaches the concave and convex outer circumferential surface 9 that is located at the deepest end of the pulley forming plates 5A and is brought into contact therewith.

In this case, as mentioned above, since the rope 1 is not brought into contact with one corner edge but brought into a plurality of and a number of corner edges in the circumferential direction, these corner edges are rounded and chamfered, and the rope 1 is likely to slip due to the number of concave and convex portions, the local cutting force is hardly generated in the rope 1.

In particular, as described above, since the apex portions of the convex and concave portions are rounded and chamfered so that a number of corrugated concave and convex portions are continuously formed to constitute the concave and convex outer circumferential surface 9, it is possible to realize the structure in which the rope 1 would not be cut because of easy slippage and the pulley forming plate 5A may readily be mounted in a rotation preventing condition.

Also, it is sufficient to form the concave and convex circumferential surface 9 simply by screwing, into the screw rod 4A, the sleeve 4B having the concave and convex outer circumferential surface 9 judged as the optimum one through the repeated tests. Also, it is sufficient to form the pulley forming plates 5A and the static plates 7 only by forming the modified hole 8 identified therewith in the middle portion thereof to make them possible to couple and rotate together with the rotary shaft 4. In particular, it is possible to readily assemble and form the pulley having the variable diameter shape with such a structure.

Incidentally, the present invention is not limited only to the embodiment but the specific structure of each constituent may be designed as desired.

With such an arrangement according to the present invention, the outer shape of the rotary shaft is formed into a rotation preventing structure, the modified hole that may be fitted and retained with identifying with the outer shape is formed in the pulley forming plates, the modified hole is simply fitted and retained to the rotary shaft so that the pulley may be coupled so as to be rotated together with the rotary shaft, in particular, the pulley forming plates are coupled in the rotation preventing manner but slidably to the rotary shaft, the interval of the pulley groove may be formed to be variable with ease, accordingly, it is possible to assemble and manufacture the device with ease and without increasing the cost to enhance the productivity, furthermore, the outer shape of the rotary shaft is not simply formed into the rectangular and the hexagonal in cross section, or the key shape is not simply formed into the single shape, and the outer shape is formed into the concave and convex outer circumferential surface which is formed by a number of concave and convex stripes having a length in the longitudinal direction and which are continuous in the circumferential direction. Accordingly, even if the rope is loosened in the initial stage upon descending and so on and the rope has the minimum winding diameter at once due to the change in the pulley groove interval so that the rope is brought into contact with the rotary shaft outer circumferential surface, the rope is hardly brought into pressing contact with one corner edge. Also, because of the easy slippage due to the number of convex and concave portions, it is possible to provide a novel refuge device from a high place which is superior in safety aspect and in which the local cutting force is hardly generated in the rope.

Also, according to a second aspect of the invention, it is possible to provide a novel refuge device from a high place which is further superior while exhibiting the further advantages and affects.

What is claimed is:

1. A refuge device from a high place in which a rotary shaft is provided rotatably within a casing provided with a rope winding portion around which a rope is wound feedably, a pulley for winding the rope to be fed is provided on the rotary shaft, static plates rotating within a closed chamber filled with oil and generating a brake force are provided on the rotary shaft, an interval of a pulley groove of the pulley is varied in response to a load to adjust the winding diameter, and a rope feeding brake mechanism for controlling so that the rope feeding velocity is kept substantially at the constant velocity irrespective of the magnitude of the load is provided, characterized in that an outer circumferential surface of the rotary shaft on which the pulley is provided and with which the rope is brought into contact while the winding diameter is at minimum upon the application of a large load is formed into a concave and convex outer circumferential surface formed by a number of circumferentially juxtaposed concave and convex stripes having a length in an axial direction and a modified hole identified with the concave and convex outer circumferential surface is fitted and retained to the rotary shaft whereby pulley forming plates of the pulley are coupled in a rotation preventing manner but slidably to the rotary shaft.

2. The refuge device from a high place according to claim 1, wherein apex portions of convex portions forming the concave and convex outer circumferential surface is rounded and chamfered and formed into the concave and convex outer circumferential surface concave and convex continuously in a wavy form in the circumferential direction, whereby when the rope is brought into contact with the concave and convex outer circumferential surface of the rotary shaft upon the application of a large load, a local cutting force is hardly generated in the rope.

* * * * *

UNITED STATES PATENT AND TRADEMARK OFFICE

CERTIFICATE OF CORRECTION

PATENT NO. : 6,745,872 B2
DATED : June 8, 2004
INVENTOR(S) : Toshiaki Sato

It is certified that error appears in the above-identified patent and that said Letters Patent is hereby corrected as shown below:

Title page,
Item [57], ABSTRACT, before the period, insert -- the rope is hardly brought into contact with one corner edge, because of the easy slippage due to the number of convex and concave portions, it is possible to provide a novel refuge device from a high place which is superior in safety aspect and in which the local cutting force is hardly generated in the rope --

Column 6,
Line 1, delete “in which” and insert -- comprising --;
Line 2, delete “is provided” and insert -- mounted --; and delete “provided with” and insert -- and having --;
Line 4, delete “provided” and insert -- mounted --;
Lines 7-9, delete “an interval of a pulley groove of the pulley is varied in response to a load to adjust the winding diameter, and --;
Line 10, delete “so that the” and insert -- a --; delete “is kept substantially at the” and insert -- of the rope at a substantially --;
Line 12, delete “ the load is provided, characterized in” and insert -- a load comprising a width of a pulley groove of the pulley being carried in response to the load to adjust a winding diameter of the pulley --;
Line 12, delete “that” and insert -- wherein --;
Line 14, delete “provided” and insert -- mounted --;
Line 15, delete “while” and insert -- when --;
Line 18, after “concave” insert -- grooves --;
Lines 18 and 19, delete “stripes having a length” and insert -- ridges extending --;
Line 19, delete “and a modified” and insert -- of the shaft, and further wherein a plate of the pulley having a --;
Line 20, delete “identified with the” and insert -- with a corresponding --; delete “outer”;
Line 23, delete “pulley forming plates of the pulley are” and insert -- the plate of the pulley is --;
Line 24, delete “slidably to” and insert -- slidable on --.
Line 52, delete “convex portions” and insert -- the convex ridges --;
Lines 55 and 56, delete “is rounded and chamfered and formed into” and insert -- are rounded, forming --;

UNITED STATES PATENT AND TRADEMARK OFFICE

CERTIFICATE OF CORRECTION

PATENT NO. : 6,745,872 B2
DATED : June 8, 2004
INVENTOR(S) : Toshiaki Sato

It is certified that error appears in the above-identified patent and that said Letters Patent is hereby corrected as shown below:

Column 6 (cont'd),
Line 56, delete "concave and convex" and insert -- into a --;
Line 56, delete "in a";
Line 60, delete "is hardly generated in the rope" and insert -- on the rope is minimized --

Signed and Sealed this

Twenty-second Day of March, 2005

JON W. DUDAS
*Director of the United States Patent and Trademark Office*

UNITED STATES PATENT AND TRADEMARK OFFICE

CERTIFICATE OF CORRECTION

PATENT NO. : 6,745,872 B2
DATED : June 8, 2004
INVENTOR(S) : Toshiaki Sato

It is certified that error appears in the above-identified patent and that said Letters Patent is hereby corrected as shown below:

Title page,
Item [57], ABSTRACT, before the period, insert -- the rope is hardly brought into contact with one corner edge, because of the easy slippage due to the number of convex and concave portions, it is possible to provide a novel refuge device from a high place which is superior in safety aspect and in which the local cutting force is hardly generated in the rope --

Column 6,
Line 30, delete "in which" and insert -- comprising --;
Line 31, delete "is provided" and insert -- mounted --; and delete "provided with" and insert -- and having --;
Line 33, delete "provided" and insert -- mounted --;
Lines 35-37, delete "an interval of a pulley groove of the pulley is varied in response to a load to adjust the winding diameter, and --;
Line 38, delete "so that the" and insert -- a --; delete "is kept substantially at the" and insert -- of the rope at a substantially --;
Line 40, delete "the load is provided, characterized in" and insert -- a load comprising a width of a pulley groove of the pulley being varied in response to the load to adjust a winding diameter of the pulley --; delete "that" and insert -- wherein --;
Line 42, delete "provided" and insert -- mounted --;
Line 43, delete "while" and insert -- when --;
Line 46, after "concave" insert -- grooves --; delete "stripes having a length" and insert -- ridges extending --;
Line 47, delete "and a modified" and insert -- of the shaft, and further wherein a plate of the pulley having a --;
Line 48, delete "identified with the" and insert -- with a corresponding --; delete "outer";
Line 50, delete "pulley forming plates of the pulley are" and insert -- the plate of the pulley is --;
Line 51, delete "slidably to" and insert -- slidable on --.
Line 53, delete "convex portions" and insert -- the convex ridges --;
Lines 54-55, delete "is rounded and chamfered and formed into" and insert -- are rounded, forming --.

UNITED STATES PATENT AND TRADEMARK OFFICE

CERTIFICATE OF CORRECTION

PATENT NO. : 6,745,872 B2
DATED : June 8, 2004
INVENTOR(S) : Toshiaki Sato

It is certified that error appears in the above-identified patent and that said Letters Patent is hereby corrected as shown below:

Column 6 (cont'd),
Line 55, delete "concave and convex" and insert -- into a --;
Line 57, delete "in a";
Line 60, delete "is hardly generated in the rope" and insert -- on the rope is minimized --

This certificate supersedes Certificate of Correction issued March 22, 2005.

Signed and Sealed this

Tenth Day of May, 2005

JON W. DUDAS
*Director of the United States Patent and Trademark Office*